United States Patent [19]

Stanier

[11] 4,432,857

[45] Feb. 21, 1984

[54] CLADDING CATHODES OF ELECTROLYTIC CELL WITH DIAPHRAGM OR MEMBRANE

[75] Inventor: Colin S. Stanier, Northwich, England

[73] Assignee: Imperial Chemical Industries PLC, London, England

[21] Appl. No.: 353,419

[22] Filed: Mar. 1, 1982

[30] Foreign Application Priority Data

Mar. 10, 1981 [GB] United Kingdom ..... 8107502

[51] Int. Cl.[3] ..... C25B 9/00; C25B 11/03; B29H 5/26; B29C 19/04

[52] U.S. Cl. ..... 204/253; 156/252; 156/267; 156/274.4; 156/275.1; 264/26; 264/154; 209/283; 209/295; 209/296

[58] Field of Search ..... 204/252, 253–258, 204/263–266, 296, 283, 282; 264/26, 154, 156; 156/252, 267, 274.4, 275.1

[56] References Cited

U.S. PATENT DOCUMENTS

| | | | |
|---|---|---|---|
| 3,142,601 | 7/1964 | Polk et al. | 264/26 X |
| 3,878,082 | 4/1975 | Gokhale | 204/252 X |
| 3,923,630 | 12/1975 | Argade et al. | 204/266 |
| 3,980,544 | 9/1976 | Adams et al. | 204/286 |
| 4,219,394 | 8/1980 | Babinsky et al. | 204/258 X |
| 4,225,400 | 9/1980 | Gunjima et al. | 204/296 X |
| 4,229,277 | 10/1980 | Specht | 204/252 |
| 4,249,974 | 2/1981 | Wilson | 156/252 X |
| 4,283,264 | 8/1981 | Darling et al. | 204/296 X |
| 4,329,217 | 5/1982 | Byrd et al. | 204/253 X |

FOREIGN PATENT DOCUMENTS

| | | |
|---|---|---|
| 10023094 | 1/1981 | European Pat. Off. . |
| 2044802 | 10/1980 | United Kingdom . |

*Primary Examiner*—Donald R. Valentine

*Attorney, Agent, or Firm*—Cushman, Darby & Cushman

[57] ABSTRACT

A method of cladding a separator, that is a diaphragm or membrane, to a cathode box of the pocket type comprising a plurality of foraminate walls, the method comprising positioning a separator in the form of a sleeve in each pocket of the cathode box with the ends of the sleeves projecting beyond the ends of the pockets, placing a first sheet material in contact with those parts of the sleeves projecting beyond the ends of the pockets in one direction and sealing the sleeves to the sheet material, placing a second sheet material in contact with those parts of the sleeves projecting beyond the ends of the pockets in the opposite direction and sealing the sleeves to the second sheet material, and removing those parts of the sheet materials adjacent to the ends of the pockets. Also a cathode box clad with separator, and an electrolytic cell comprising a cathode box clad with separator.

14 Claims, 7 Drawing Figures

CLADDING CATHODES OF ELECTROLYTIC CELL WITH DIAPHRAGM OR MEMBRANE

Figure 1:
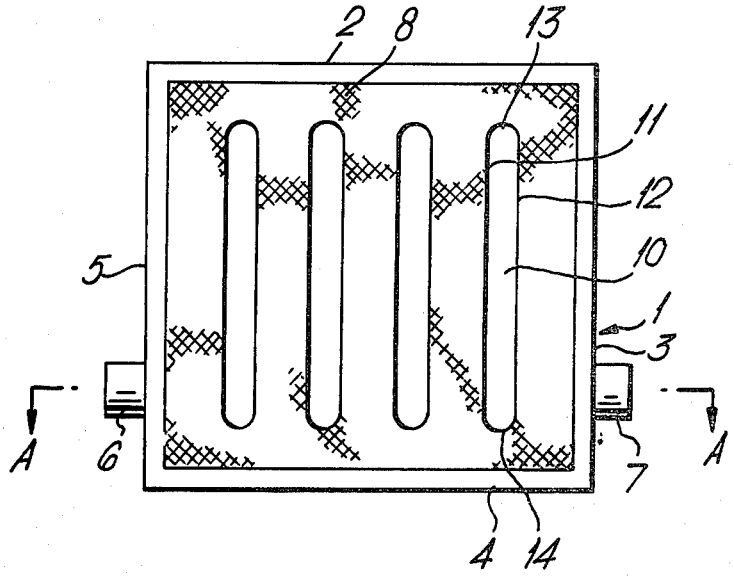

This invention relates to a method of cladding a cathode box of an electrolytic cell with a diaphragm or membrane, to a cathode box clad with diaphragm on membrane, and to an electrolytic cell comprising a cathode box clad with diaphragm or membrane.

The cathodes clad with diaphragm or membrane in the method of the invention are of the type generally useful in electrolytic cells for the electrolysis of aqueous alkali metal chloride solution to produce chlorine and alkali metal hydroxide solution, especially the production of chlorine and sodium hydroxide solution by the electrolysis of aqueous sodium chloride solution. However, it is to be understood that the invention is not so limited and that the cathodes clad with diaphragm or membrane may be used in electrolytic cells for the electrolysis of solutions of ionisable chemical compounds other than aqueous alkali metal chloride solutions.

Such electrolytic cells may comprise a cathode box having side walls and a plurality of cathode fingers or pockets generally parallel to each other, and within the box a plurality of anodes evenly spaced from each other and also generally parallel to each other and fixed to a base, the anodes being positioned between adjacent cathode fingers or in the cathode pockets of the cathode box. A hydraulically permeable diaphragm material or an ionically permselective membrane material is positioned on the cathode fingers or in the cathode pockets and divides the cell into separate anode and cathode compartments. The cathode fingers or pockets may have a foraminate structure, and the cell is equipped with a top or header through which electrolyte solution may be fed to the cell and with means for removing the products of electrolysis from the cell.

For many years the foraminate structures in cathode boxes of electrolytic cells have been clad with asbestos diaphragms by immersing the cathode box in a suspension of asbestos fibres in, for example, cell liquor, and drawing the asbestos fibres by suction onto the foraminate structure. A hydraulically permeable mat of asbestos fibres is thereby formed on the foraminate structure of the cathode box. Although such asbestos diaphragms have been used for many years, and of course continue to be used on a large scale, there is a need to replace asbestos diaphragms by other materials which do not swell during use in electrolysis. Thus, where aqueous alkali metal chloride solution is electrolysed in a cell equipped with an asbestos diaphragm the anode-cathode gap must be greater than is desirable, with consequent increase in voltage, at least in part to provide for the swelling of the asbestos diaphragm which takes place during electrolysis. There is also a need to replace asbestos by materials which do not have the toxic properties of asbestos and which have a longer effective lifetime than asbestos.

Many different types of hydraulically permeable diaphragms made of synthetic polymeric materials have been developed. For example, in British Pat. No. 1 081 046 in the name of Imperial Chemical Industries Limited there is described a sheet diaphragm of porous polytetrafluoroethylene which is produced by forming a sheet of polytetrafluoroethylene and a particulate filler, e.g. starch, and extracting the filler from the sheet. In British Pat. No. 1 503 915, also in the name of Imperial Chemical Industries Limited, there is described an electrochemical cell, particularly suitable for use in the production of chlorine and alkali metal hydroxide by the electrolysis of aqueous alkali metal chloride solution, the cell comprising an anode and a cathode separated by a porous polytetrafluoroethylene diaphragm which has a microstructure of nodes interconnected by fibrils. The porous polytetrafluoroethylene sheet suitable for use as the diaphragm, and a method of producing the sheet, are described in British Pat. No. 1 355 373 in the name of W. L. Gore and Associates Inc.

In recent years a number of substantially hydraulically impermeable ionically permselective membrane materials have been developed, particularly for use in electrolytic cells for the electrolysis of aqueous alkali metal chloride solutions in which it is desired to produce alkali metal hydroxide solution substantially free of alkali metal chloride. These membrane materials generally comprise fluorine-containing polymeric materials containing cation-exchange groups, for example, sulphonic acid, carboxylic acid or phosphonic acid groups, or derivatives thereof. The polymeric materials may be perfluorinated, and the cation-exchange groups may be present in units derived by polymerisation of perfluoro vinyl ethers containing the cation-exchange groups. Such cation-exchange membranes are described, for example, in British Pat. Nos. 1184321, 1402920, 1406673, 1455070, 1497748, 1497749, 1518387 and 1531068.

Many of the synthetic diaphragms and membranes which have been developed cannot be applied to the foraminate cathodes of electrolytic cells by the techniques which have hitherto been used to apply asbestos diaphragms to such foraminate structures. Furthermore, a synthetic diaphragm or membrane in the form of a sheet or film is difficult to apply to a cathode box in which the foraminate cathodes are in the form of a plurality of fingers or pockets. It is difficult to ensure that the diaphragm or membrane conforms to the somewhat irregular shape of the surfaces of such cathode boxes and it is also difficult to ensure that the diaphragm or membrane is adequately sealed so that it is free of leaks. Special techniques have had to be developed to clad such cathodes boxes with synthetic diaphragm or membrane.

Many of the techniques hitherto described involve the use of mechanical clamping devices.

Thus in Belgian Pat. No. 864 400 in the name of the Olin Corporation there is described a sheath for cladding an essentially rectangular electrode, the sheath having a closed end, an open end, and two closed sides, at least one of the closed sides consisting of a main section and a section in the form of a lug, the lug being adjacent to the open end. In use the sheath is placed over the cathode and the lug, which is flexible, is bent or twisted to form an essentially flat surface, and methods of clamping or gripping are applied for the effective sealing of the sheaths along their upper and lower edges. The sheaths described are suitable for use in the cladding of a cathode box containing a plurality of cathodes of the finger type.

In U.S. Pat. No. 3,980,544, also in the name of the Olin Corporation, there is described a diaphragm in the form of an envelope which is suitable for cladding foraminate electrodes, especially cathodes, which are positioned parallel to each other and which have a space between each electrode, the diaphragm envelope having an open end and having two adjoining edges which are clamped between a clamping element and a bar positioned between the electrodes. This diaphragm structure and clamping method is particularly suitable for cladding of finger type electrodes.

In U.S. Pat. No. 3,878,082, in the name of BASF Wyandotte Corporation there is described a means for cladding cathodes of both the finger type and the pocket type. In a cathode box comprising cathodes of the finger type a diaphragm in the form of an envelope is positioned over the cathode finger and a U-shaped retainer is positioned over the diaphragm at the junction between adjacent cathode fingers. In a cathode box of the pocket type the diaphragm is wrapped over the cathode and retained in the pocket by means of crescent shaped retainers positioned over the diaphragms in the pocket. U-shaped retainers are also placed over the diaphragm, the U-shaped retainers also cooperating with the crescent shaped retainers.

There are number of prior disclosures in which the means of cladding the cathode box necessitates the use of slotted support members which are positioned above and below the qathode box with the slots in the support members being aligned with the pockets in the cathode box. In such cladding methods a sleeve of diaphragm or membrane is placed in each pocket of the cathode box and sealed to the upper and lower slotted support members.

Thus, in U.S. Pat. No. 3,923,630, in the name of BASF Wyandotte Corporation the slotted support members have upstanding lips and diaphragm sleeves are sealed to the lips of the support members. This sealing may be effected by heat sealing, as described in Belgian Pat. No. 865,864, or by mechanical means, as described in European Patent Publication No. 0008165, both in the name of Imperial Chemical Industries Limited.

In published British Patent Application No. 2044802A in the name of Kanegafuchi there is described a method of cladding a cathode box in which the upper and lower horizontal surfaces of a cathode box are covered with so-called membrane installation frames having slots therein, and in which membranes sleeves having flares at both ends are positioned in the pockets of the cathode box and the flared portions are fixed to the membrane installation frames by mechanical means, or by welding thereto, e.g. by heat sealing.

The present invention provides a means for cladding a cathode box comprising a plurality of foraminate cathodes of the pocket type which is particularly effective and which does not rely for its effectiveness on the provision of shaped mechanical clamping devices to position and seal the diaphragm or membrane in the cathode box. Furthermore, the method does not rely for its effectiveness on the provision of slotted support members of the type hitherto described, and thus does not necessitate accurate positioning of a diaphragm or membrane sleeve in relation to the slots in such a slotted support member.

The present invention is applicable not only to the cladding of a cathode box with a diaphragm which is hydraulically permeable and which permits electrolyte to flow through the diaphragm between the anode and cathode compartments of the electrolytic cell but also to the cladding of a cathode box with substantially hydraulically impermeable materials, commonly referred to as membranes, which permit selective transfer of ionic species between the anode and cathode compartments of an electrolytic cell.

Unless otherwise stated, we will for simplicity refer hereafter to "separators" and it is to be understood that the term "separators" as used includes both hydraulically permeable materials and substantially hydraulically impermeable ionically permselective materials. Within the scope of the term "diaphragm" we also include materials which may not be hydraulically permeable but which are readily converted to a hydraulically permeable form, for example, by extraction of a particulate substance from the material. Within the scope of the term "membrane" we include materials which are not ionically permselective but which may readily be converted to an ionically permselective form, for example by hydrolysis.

The method of cladding of the present invention is suitable for use in the cladding of a cathode box comprising a plurality of foraminate cathodes of the pocket type by which we mean a cathode box having side walls, a top and a bottom which may have a foraminate structure, and a plurality of pockets substantially parallel to each other and formed by foraminate walls positioned between the top and bottom, the pockets forming cavities in which the anodes of an electrolytic cell may be positioned. The pockets, in plan view, are generally but not necessarily elongated in shape having two substantially parallel and relatively long side walls and two relatively short end walls joining the side walls.

According to the present invention there is provided a method of cladding a separator to a cathode box of the pocket type for use in an electrolytic cell in which method a separator in the form of a sleeve is positioned in each pocket of the cathode box with the ends of the sleeves projecting beyond the ends of the pockets, a first sheet material is placed in contact with those parts of the sleeves projecting beyond the ends of the pockets in one direction and the sleeves are sealed to the sheet material, a second sheet material is placed in contact with those parts of the sleeves projecting beyond the ends of the pockets in the opposite direction and the sleeves are sealed to the second sheet material, and those parts of the sheet materials adjacent to the ends of the pockets are removed.

As the method of the invention does not require the use of slotted support members there is no need for accurate alignment of the sleeves with the slots in such support members. Furthermore, as the slots in the sheet materials are formed after sealing of the sleeves thereto, by removing those parts of the sheet materials adjacent to the ends of the pockets, that is inboard of the seals, the cladding of a cathode box is greatly facilitated. The method of the invention does not require the use of mechanical clamping devices.

Where the separator is a hydraulically permeable diaphragm it may be made of a porous organic polymeric material. Preferred organic polymeric materials are fluorine-containing polymers on account of the generally stable nature of such materials in the corrosive environment encountered in many electrolyte cells. Suitable fluorine-containing polymeric materials include, for example, polychloro-trifluoroethylene, fluorinated ethylene-propylene copolymer, and polyhexafluoropropylene. A preferred fluorine-containing polymeric material is polytetra-fluoroethylene on account of its stability in corrosive electrolytic cell environments, particularly in electrolytic cells for the production of chlorine and alkali metal hydroxide by the electrolysis of aqueous alkali metal chloride solutions. Such hydraulically permeable diaphragm materials are known in the art.

Where the separator is a substantially hydraulically impermeable ionically permselective membrane capable of transferring ionic species between the anode and cathode compartments of an electrolytic cell the membrane is preferably cation permselective. Such materials are known in the art and are preferably fluorine-containing polymeric materials containing anionic groups. The polymeric materials preferably are fluorocarbons containing the repeating groups $$\left[C_mF_{2m}\right]_M \quad \text{and} \quad \left[CF_2-\underset{\underset{X}{|}}{CF}\right]_N$$

where m has a value of 2 to 10, and is preferably 2, the ratio of M to N is preferably such as to give an equivalent weight of the groups X in the range 600 to 2000, and X is chosen from $$A \text{ or } \left[OCF_2-\underset{\underset{Z}{|}}{CF}\right]_p A$$

where p has a value of for example 1 to 3, Z is fluorine or a perfluroalkyl group having from 1 to 10 carbon atoms, and A is a group chosen from the groups:

—$SO_3H$
—$CF_2SO_3H$
—$CCl_2SO_3H$
—$X^1SO_3H$
—$PO_3H_2$
—$PO_2H_2$
—COOH and
—$X^1OH$ or derivatives of the said groups, where $X^1$ is an aryl group. Preferably A represents the group $SO_3H$ or —COOH. $SO_3H$ group-containing ion exchange membranes are sold under the trade name 'Nafion' by E. I. du Pont de Nemours and Co. Inc. and —COOH group-containing ion exchange membranes under the trade name 'Flemion' by the Asahi Glass Co. Ltd.

The separator in the form of a sleeve may be made from a separator material in sheet or film form, for example, by sealing together opposite edges of a square or oblong-shaped sheet, e.g. by overlapping the opposite edges of the sheet and sealing together the overlapped portions, or by sealing opposite edges of the sheet to a strip of a suitable material.

In a preferred form, which facilitates sealing of the sleeves to the sheet materials, both ends of the sleeves are flared at least to an extent which facilitates face-to-face contact between the ends of the sleeves and the sheet materials. The flared ends of the sleeves may be formed by sealing suitable flared portions to the sleeves. Those parts of the sleeves, or at least a substantial part thereof, which in the cathode box are positioned within the pockets are formed of a separator material. Those part of the sleeves which project beyond the ends of the pockets of the cathode box, for example, the flared ends of the sleeves may be formed of a material which is neither hydraulically nor ionically permeable. Alternatively, the flared ends may be formed by folding the ends of the sleeve over a suitably shaped former.

The sheet materials which in the method of the invention are sealed to the sleeves of separator material may themselves be made of a separator material. Thus, where the sleeves are diaphragms made of a material which is hydraulically permeable the sheet materials may also be made of a material which is hydraulically permeable, which latter material may be the same as or different from that of the sleeves. Where the sleeves are membranes made of a material which is substantially hydraulically impermeable and which is ionically permselective the sheet materials may also be made of a material which is substantially hydraulically impermeable and ionically permselective, which latter material may be the same as or different from that of the sleeves.

Where the sleeves are diaphragms the sheet materials may even be made of a membrane material. However, where the sleeves are made of a membrane material the sheet materials should be substantially hydraulically impermeable and thus should not be diaphragm material.

Alternatively, the sheet materials may be neither a diaphragm material nor a membrane material, and may comprise, for example, an organic polymeric material which is neither hydraulically nor ionically permeable. Such organic polymeric materials should be resistant to the conditions prevailing in the electrolytic cell, and they are preferably fluorine-containing polymeric materials, particularly where the clad cathode box is to form part of an electrolytic cell which is to be used in the electrolysis of aqueous alkali metal chloride solution. Thus, the sheet materials may be formed of a perfluoro polymeric material, for example, polytetrafluoroethylene or tetrafluoroethylene-hexafluoropropylene copolymer.

The sealing methods used to seal the sleeves to the sheet materials, and used in the production of the sleeves, are not limited to any particular method. Thus, sealing may be effected for example by use of suitable adhesives or by the use of welding techniques, for example, by heat sealing using heated platens, or by radio-frequency heating.

It is to be understood that the particular method of sealing for use in the method of the invention will be chosen bearing in mind the nature of the separator and/or the sheet material, and furthermore, that certain methods of sealing may be unsuitable for use with certain separator and/or sheet materials. For example, whilst in general suitable adhesives may be used to seal a variety of separator materials to sheet materials, which may be the same or different, we have found that where the separator is a membrane made of a fluorine-containing polymer containing ion-exchange groups difficulty may be experienced in certain circumstances in welding the polymer to itself to form a sleeve and in sealing the sleeve to a sheet material made of the same polymer. Thus, difficulty may be experienced particularly where the polymer contains ion-exchange groups in the form of metal salts of acidic groups, e.g. alkali metal salts of sulphonic, carboxylic or phosphonic groups, and where welding is to be used the aforementioned acidic groups are preferably in the hydrogen form or in the form of esters, particularly lower alkyl esters, e.g. methyl esters. After sealing, the ester form may be converted to the ionically permeable acid or salt form.

A choice of the method of sealing to be used with a particular separator and/or sheet material may suitably be made by means of simple experiment.

In the method of the invention the sheet materials are placed in contact with those parts of the sleeves projecting beyond the ends of the pockets, and in a preferred embodiment with the flared ends of the sleeves thereby facilitating face-to-face contact between the sleeves and the sheet material.

Sealing may be effected by applying a suitable adhesive to the projecting parts of the sleeves, e.g. to the flared ends, then effecting contact with the sheet materials, and if necessary applying heat and/or pressure to the areas of the sleeves and sheet materials which are in contact.

In effecting sealing by use of welding techniques, heat sealing may be used. Thus, the sheet material and the projecting end of a sleeve, e.g. a flared end, may be held between platens, one or both of which may be heated, until the end of the sleeve is sealed to the sheet material. If necessary, pressure may be applied through the platens to assist the heat sealing process.

In effecting sealing by means of radio frequency heating, the sheet material and the projecting end of a sleeve, e.g. a flared end, may be positioned between electrodes and a high frequency alternating magnetic field created between the electrodes. The sealing may be assisted by the application of pressure through the electrodes to the material to be sealed. The frequency of the alternating current applied to the electrodes will generally be in the megacycle range, for example, between 1 and 100 megacycles per second. In general a frequency in the range 10 to 50 megacycles per second will be suitable.

The time required for effecting a heat seal will depend in part on the nature of the materials to be heat sealed and in particular the softening points of the materials and suitable times and temperatures, and frequencies in the case of radio frequency heating, may be determined by means of simple experiment, for example on small samples of the material to be heat sealed.

Where a welding technique is used, one platen or electrode may be positioned within a pocket of the cathode box inboard of the sleeve and the end of the sleeve flared inwardly over the end of the platen or electrode. In order to weld the sleeve to one of the sheet materials another platen or electrode is placed on the sheet with the sheet and the flare of the sleeve being located in contact with each other between the platens or electrodes. The platen or electrode positioned in the pocket will have a shape similar to that of the pocket of the cathode box. After the sealing has been effected, the part of the sheet adjacent to the end of the pocket of the cathode box, that is inboard of the seal, is removed and a similar procedure is followed in order to seal the sleeve in an adjacent pocket to the sheet material. Thereafter the opposite ends of the sleeves are similarly sealed to a second sheet material.

The cathode box may comprise a large number of pockets, for example up to 50 pockets, into each of which a sleeve is positioned and it is desirable to provide some means for retaining the sleeves in position in the pockets during cladding of the cathode box. Such a means may be provided by an inflatable bag positioned in each pocket and inflated sufficiently to hold the sleeves in contact with the foraminate surfaces of the cathode box. Prior to insertion of a platen or electrode into a particular pocket of the cathode box the inflated bag which is positioned in the particular pocket will be deflated and removed.

The sheet materials to which the sleeves are sealed should cover at least the surfaces of the cathode box between which the pockets are positioned, and preferably the sheet materials project to the edges of these surfaces so that the edges of the sheet materials may be clamped between the walls of the cathode box and the base of the electrolytic cell on which the box is placed, and between the walls of the cathode box and the top of the electrolytic cell placed on the cathode box.

In the final step of the method of the invention those parts of the sheet materials adjacent to the ends of the pockets of the cathode box, that is inboard of the seals, are removed, in order that when the electrolytic cell is assembled the anodes, suitably mounted on a cell base, may be positioned within the pockets of the cathode box and within the sleeves of separator material. The parts of the sheet materials may be removed by cutting the sheet materials, e.g. with a knife. Care should be exercised to remove only those parts of the sheet materials inboard of the seal between the sleeves and the sheet material so as not to damage the seal. Alternatively, where heated platens or electrodes are used to effect the seal, the platens or electrodes may be so shaped as to produce perforations in the sheet material inboard of the seal and the part of the sheet material inboard of the seal may be removed merely by tearing it from the sheet material.

In general, in effecting the method of the invention, those parts of all of the sleeves projecting beyond the ends of the pockets in one direction will be sealed to a first sheet material and those parts of the sheet material adjacent to the ends of the pockets and inboard of the seals will thereafter be removed, and thereafter those parts all of the sleeves projecting beyond the ends of the pockets in the opposite direction will be sealed to a second sheet material, and finally those parts of the second sheet material adjacent to the ends of the pockets and inboard of the seals will be removed.

The cathode box clad with a separator in the method of the invention may be equipped with a port or ports for removing cell liquor and gaseous products therefrom, and with a port through which liquid, e.g. water, may be charged to the cathode box. The foraminate surfaces of the cathode box may be of expanded metal or of a perforated, woven or net structure. The cathode box, and particularly the foraminate surfaces thereof, are preferably made of steel, e.g. mild steel, or of nickel, especially in the case where the electrolytic cell is to be used in the electrolysis of an aqueous alkali metal chloride solution.

The anodes in the electrolytic cell may suitably be mounted on a base and be so positioned that, when the cathode box is positioned thereon, the anodes are located in the pockets of the cathode box and within the sleeves of separator material. The anodes, and the base, may be made of a film-forming metal or alloy thereof, that is titanium, niobium, zirconium, tantalum or tungsten or alloy thereof, and the anodes may carry a surface coating of an electroconducting electrocatalytically active material, for example, a coating comprising a platinum group metal and/or a platinum group metal oxide. A preferred coating is a mixed oxide coating of a platinum group metal oxide and a film-forming metal oxide, e.g. $RuO_2$ and $TiO_2$. In the electrolytic cell an anolyte header tank may be positioned on top of the cathode box, the header tank being equipped with a port through which electrolyte may be fed to the anode compartments of the cell and ports through which gaseous products of electrolysis and depleted electrolyte may be removed from the cell.

The invention is now illustrated by the following drawings in which

Figure 2:
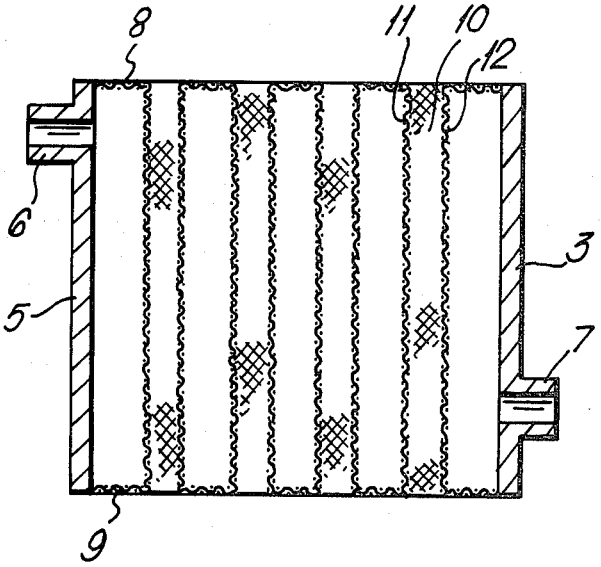
Figure 3:
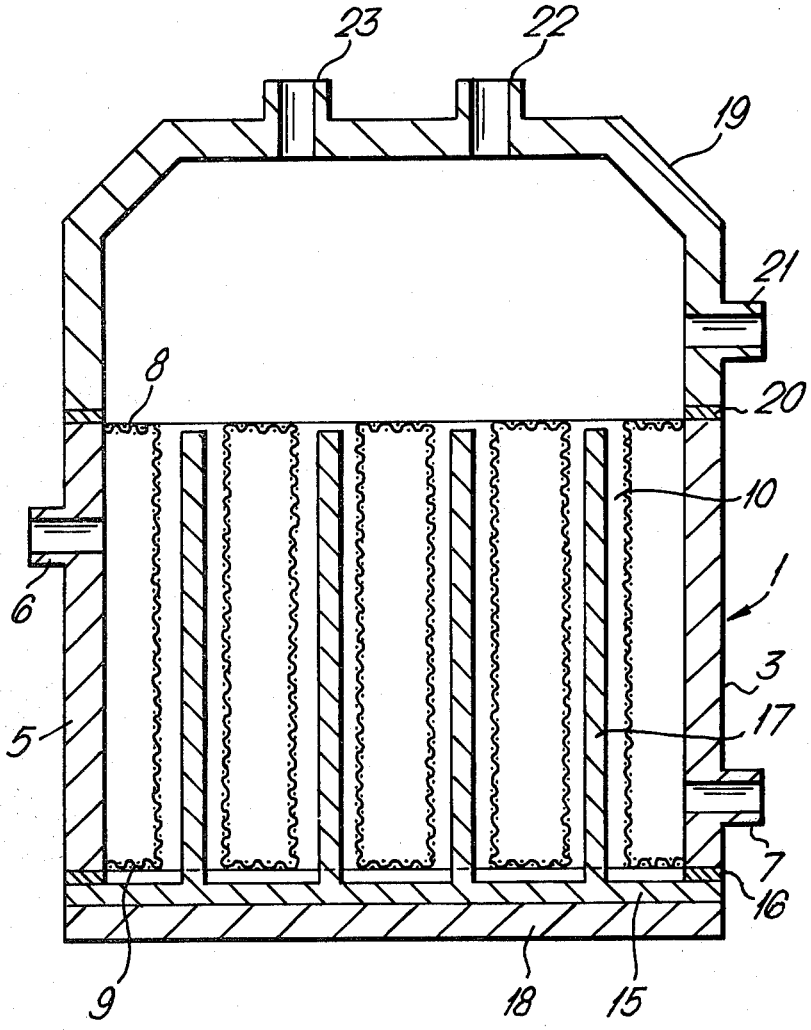
Figure 4:
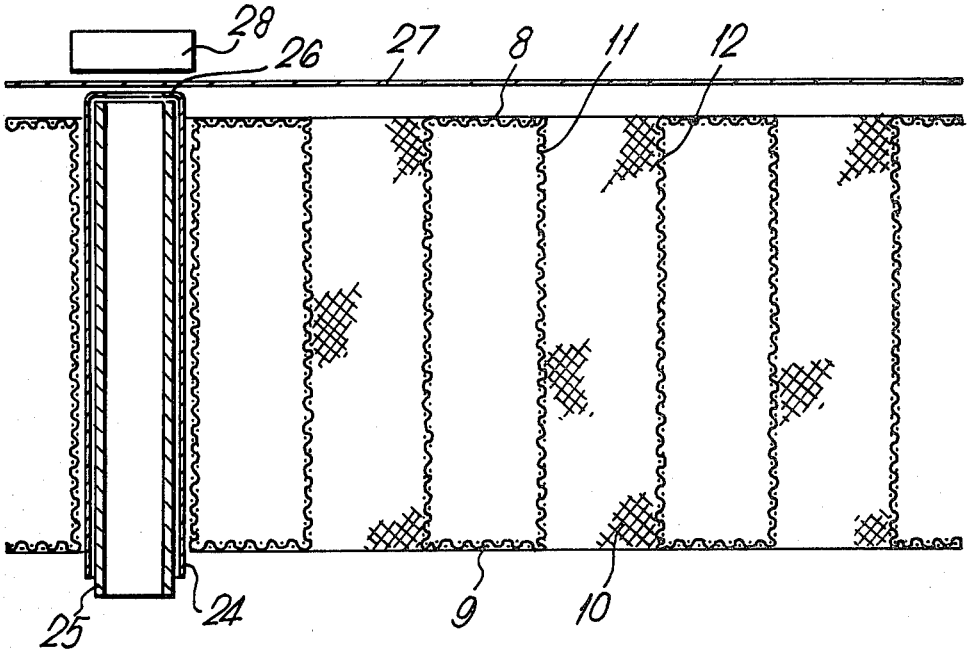
Figure 7:
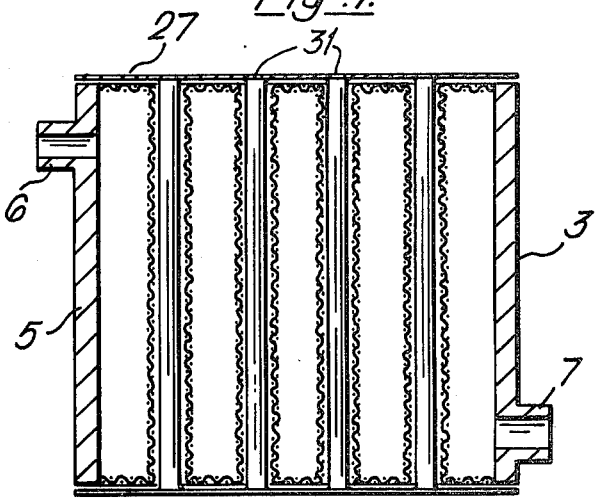
Figure 5:
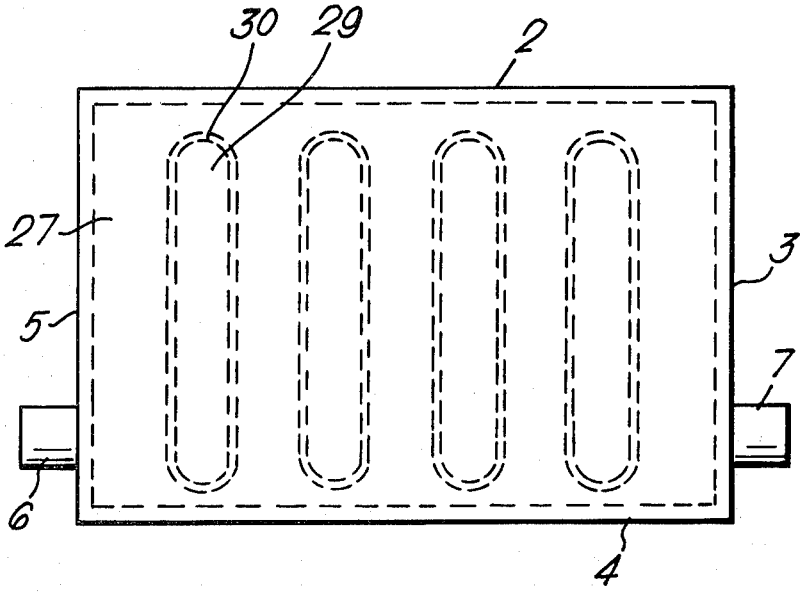
Figure 6:
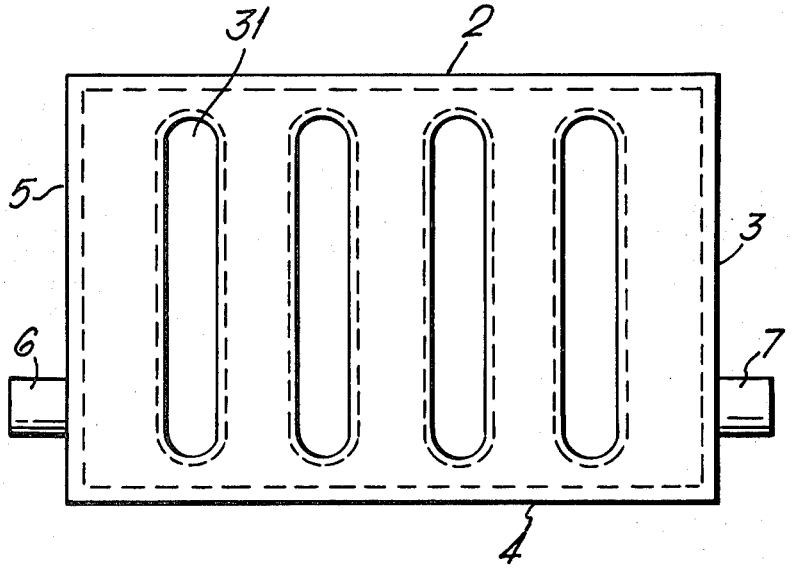

FIG. 1 is a plan view of a cathode box which is to be clad with a separator in the method of the invention, FIG. 2 is a cross-sectional view in elevation of the cathode box along the line A—A of FIG. 1, FIG. 3 is a cross-sectional view in elevation of an electrolytic cell, for the sake of convenience the separator having been omitted from the cell which is shown, FIGS. 4, 5 and 6 are diagrammatic views illustrating the method of cladding of the cathode box with separator, and FIG. 7 illustrates the cathode box of FIG. 2 clad with separator.

Referring to FIGS. 1 to 3 the cathode box (1) comprises side walls (2,3,4,5) equipped with ports (6,7) through which water or other liquid may be fed to the cathode box and through which liquid and gaseous products of electrolysis may be removed from the cathode box, a foraminate top (8), and a foraminate base (9). The foraminate structure may for example be an expanded metal or of woven wire mesh, suitably of mild steel, where the cell is to be used for the electrolysis of an aqueous alkali metal chloride solution. The cathode box comprises four pockets (10) which are parallel to each other and which are elongated in shape and which are formed by side walls (11,12) and end walls (13,14) between the foraminate top (8) and foraminate base (9) of the cathode box. For the sake of convenience in the embodiment illustrated the cathode box has been shown as comprising four pockets only. It is to be understood that the cathode box may comprise a much larger number of pockets, for example forty or more such pockets. The cathode box is also equipped with an electrical connection which for the sake of convenience is not shown.

The electrolytic cell shown in FIG. 3 comprises a cathode box (1) which is positioned on a baseplate (15) and insulated therefrom by a gasket (16) of an electrically insulating material which is resistant to corrosion by the liquors in the cell. A plurality of anodes (17) are mounted on the baseplate (16). The anodes are parallel to each other and positioned in the pockets (10) of the cathode box. A base (18) through which electrical power may be fed to the anodes of the cell is in electrical contact with the baseplate (16). The connection of the power source is conventional and for the sake of convenience is not shown.

Where the electrolytic cell is to be used in the electrolysis of aqueous alkali metal chloride solution the anodes (17) may suitably be coated with a layer of an electroconducting electrocatalytically active material of the type hereinbefore described. The anodes may have foraminate surfaces.

An anolyte header (19) is positioned on the cathode box (1) and insulated therefrom by means of a gasket (20) of an electrically insulating material which is resistant to corrosion by the liquors in the cell. The anolyte header (19) is equipped with three ports (21,22,23) through which, respectively, electrolyte solution may be fed to the cell and gaseous products of electrolysis and depleted electrolyte solution may be removed from the cell.

FIG. 4 illustrates a part only of the cathode box of FIG. 2, the walls (3,5) and the ports (6,7) having been omitted for the sake of convenience. In order to clad a pocket of the cathode box with separator a separator sleeve (24), formed by sealing together opposite edges of an oblong-shaped sheet and having the same general shape as that of the pocket (10) of the cathode box, is positioned in the pocket. An electrode (25), also having the same general shape as that of the pocket (10) is then positioned in the pocket inboard of the sleeve (24) and the end (26) of the sleeve (24) is flared by folding inwardly over the upper end of the electrode (25). A sheet of separator material (27) is placed over the foraminate top (8) of the cathode box in contact with the end (26) of the sleeve (24) and a second electrode (28) is placed on top of the sheet. The electrodes (25,28) are connected to a suitable high frequency source of electrical power (not shown), a high freqency alterating magnetic field is created between the electrodes, pressure is applied through the electrodes to the sheet (27) and the end (26) of the sleeve (24), and the sheet is sealed to the sleeve by radio frequency heating. The electrodes are then removed and sleeves in adjacent pockets of the cathode box are similarly sealed to the sheet 27. The parts (29) inboard of the seals (30) in the sheet of separator material (27), see FIG. 5, are then removed by cutting with a knife to leave slots (31), see FIG. 6, in the sheet of separator material.

Thereafter, the above procedure is repeated to seal a second sheet of separator material to the opposite ends of the sleeves (24) in the pockets (10) of the cathode box.

The cathode box clad with separator material is shown in FIG. 7.

In order to assemble the electrolytic cell the cathode box (1) clad with separator is placed on the baseplate (16) and the anolyte header tank (19) is placed on the cathode box in the manner hereinbefore indicated, and the cell is bolted together.

The electrolyte cell is operated by feeding aqueous alkali metal chloride solution to the anolyte header (19) through port (21) and gaseous chlorine produced in electrolysis is removed through port (22). Depleted alkali metal chloride solution may if necessary be removed through port (23). Where the separator is a hydraulically permeable diaphragm the solution of alkali metal chloride passes through the diaphragm and hydrogen and a solution of alkali metal hydroxide containing alkali metal chloride is removed from the cathode box through port (6). Where the separator is a substantially hydraulically impermeable ion exchange membrane water or dilute alkali metal hydroxide solution is fed to the cathode box through the port (7), and hydrogen and aqueous alkali metal hydroxide solution are removed from the cathode box through port (6).

A cathode box of the type described was clad with a membrane material comprising a film of copolymer of tetrafluoroethylene and a perfluorovinyl ether carboxylic ester, and thereafter the carboxylic ester groups in the membrane were converted to the sodium salt form by contacting membrane with aqueous sodium hydroxide solution. The heat sealing was effected using a radio frequency heating apparatus (Radyne Ltd) at a frequency of 27 megacycles per second and a heating time for each seal of 3 minutes.

The cathode box was then assembled in an electrolytic cell of the type described equipped with titanium anodes having a coating of mixture of $RuO_2$ and $TiO_2$ (35:65 weight:weight) and saturated aqueous sodium chloride solution was electrolysed at an anode current density of 2.9 kA/m$^2$, a temperature of 85° C. and a voltage of 3.8 volts. Water was charged to the cathode compartment during the electrolysis and 35% by weight sodium hydroxide solution was produced at a current efficiency of 95%. The sodium hydroxide solution contained 10 parts per million of sodium chloride indicating that there was no leakage of sodium chloride electrolyte from the anode compartment to the cathode compartment.

I claim:

1. A method of cladding a separator to a cathode box of the pocket type for use in an electrolytic cell, the cathode box comprising side walls, a top and bottom, and a plurality of pockets substantially parallel to each other and formed by foraminate walls positioned between the top and bottom, characterised in that a separator in the form of a sleeve is positioned in each pocket of the cathode box with the ends of the sleeves projecting beyond the ends of the pockets, a first sheet material is placed in contact with those parts of the sleeves projecting beyond the ends of the pockets in one direction and the sleeves are sealed to the sheet material, a second sheet material is placed in contact with those parts of the sleeves projecting beyond the ends of the pockets in the opposite direction and the sleeves are sealed to the second sheet material, and those parts of the sheet materials adjacent to the ends of the pockets are removed.

2. A method as claimed in claim 1 characterised in that the separator is a hydraulically permeable diaphragm.

3. A method as claimed in claim 1 characterised in that the separator is a substantially hydraulically impermeable ionically permselective membrane.

4. A method as claimed in claim 1 characterised in that the ends of the sleeves are flared.

5. A method as claimed in claim 4 characterised in that the ends of the sleeves are inwardly flared.

6. A method as claimed in claim 1 characterised in that the sheet materials comprise an organic polymeric material.

7. A method as claimed in claim 1 characterised in that the sheet materials are made of a separator material.

8. A method as claimed in claim 7 characterised in that the sleeves and the sheet materials are made of a material which is hydraulically permeable.

9. A method as claimed in claim 7 characterised in that the sleeves and the sheet materials are made of a material which is substantially hydraulically impermeable and which is ionically permselective.

10. A method as claimed in claim 1 characterised in that the sleeves are sealed to the sheet materials by heat sealing.

11. A method as claimed in claim 10 characterised in that heat sealing is effected by use of radio frequency heating.

12. A method as claimed in claim 10 characterised in that a platen or electrode is positioned within a pocket of the cathode box inboard of the sleeve therein with the end of the sleeve flared inwardly over the end of the platen or electrode, a second platen or electrode is placed on the sheet material, and the end of the sleeve is contacted with the sheet material and heat sealed thereto.

13. A cathode box clad with a separator by a method as claimed in claim 1.

14. An electrolytic cell comprising a cathode box having a plurality of pockets therein substantially parallel to each other and formed by foraminate walls, a plurality of anodes substantially parallel to each other and positioned in the pockets of the cathode box, characterised in that the cathode box is clad with a separator by a method as claimed in claim 1.

* * * * *